US005720246A

United States Patent [19]

Griffin et al.

[11] Patent Number: 5,720,246

[45] Date of Patent: Feb. 24, 1998

[54] CONTINUOUS FIBER REINFORCED ALUMINUM MATRIX COMPOSITE PUSHROD

[75] Inventors: Christopher J. Griffin, Inver Grove Heights; Ronald F. Waxon, Cottage Grove; D. Lee Host, Brooklyn Park, all of Minn.

[73] Assignee: Minnesota Mining and Manufacturing, St. Paul, Minn.

[21] Appl. No.: 685,281

[22] Filed: Jul. 23, 1996

[51] Int. Cl.[6] ..... F01L 1/14

[52] U.S. Cl. ..... 123/90.61

[58] Field of Search ..... 123/90.61, 90.62, 123/90.63, 90.64; 74/579 R; 29/888.2

[56] References Cited

U.S. PATENT DOCUMENTS

| | | | |
|---|---|---|---|
| 3,547,180 | 12/1970 | Cochran | 164/61 |
| 3,661,127 | 5/1972 | Cornell | 123/90.27 |
| 3,859,969 | 1/1975 | Davis, Jr. | 123/90.61 |
| 3,918,833 | 11/1975 | Eilertson | 416/20 |
| 3,963,280 | 6/1976 | Irving | 308/5 V |
| 4,186,696 | 2/1980 | Linsenmann | 123/90.61 |
| 4,442,770 | 4/1984 | Dozier | 101/93.32 |
| 4,453,505 | 6/1984 | Holtzberg et al. | 123/90.61 |
| 4,506,721 | 3/1985 | Ban et al. | 164/97 |
| 4,645,639 | 2/1987 | Potter | 376/260 |
| 4,848,286 | 7/1989 | Bentz | 123/90.61 |
| 4,864,983 | 9/1989 | Breitbarth | 123/90.61 |
| 4,954,462 | 9/1990 | Wood et al. | 501/95 |
| 5,000,137 | 3/1991 | Wreinert et al. | 123/90.61 |
| 5,044,329 | 9/1991 | Jamora | 123/90.61 |
| 5,095,862 | 3/1992 | Murphy | 123/90.61 |
| 5,154,146 | 10/1992 | Hagerman et al. | 123/90.61 |
| 5,372,100 | 12/1994 | Bertelson | 123/90.61 |

FOREIGN PATENT DOCUMENTS

WO 94/06619 3/1994 WIPO .

*Primary Examiner*—Weilun Lo

*Attorney, Agent, or Firm*—Walter N. Kirn; Gary L. Griswold; Gregory D. Allen

[57] ABSTRACT

A valve train pushrod, for an internal combustion engine is disclosed. The pushrod is formed of a hollow rod of continuous, fiber reinforced aluminum matrix composite, having hard end caps bonded to each end. A method of manufacture for the pushrod is disclosed as well.

23 Claims, 3 Drawing Sheets

CONTINUOUS FIBER REINFORCED ALUMINUM MATRIX COMPOSITE PUSHROD

FIELD OF THE INVENTION

This invention relates to valve train pushrods for use in internal combustion engines, and more particularly to such pushrods incorporating continuous fiber reinforced aluminum matrix composites.

BACKGROUND OF THE INVENTION

Internal combustion engines typically employ a "valve train" which regulates the motion of valves used to control the flow of combustion and exhaust gases into and out of each engine cylinder. Among the numerous components of valve trains are "pushrods" which serve, among other components, to convert rotating motion from the rotating camshaft of the engine into linear motion of the individual valves on each cylinder. The multiplicity of moving parts, and the high energies involved in modern combustion engines, often result in significant amounts of undesired vibration and noise, and can result in decreased engine speed and efficiency. It has long been recognized that improvements to the valve train can lead to significant improvements in overall engine performance. More particularly, valve train components of reduced weight and/or improved vibration damping properties have been suggested as possible enhancements to lower engine noise, increase engine speed, increase engine power and improve fuel efficiency.

Pushrods fabricated of composite materials have been proposed. For example, U.S. Pat. No. 4,453,505 describes a graphite and/or glass fiber reinforced amide/imide polymer matrix composite pushrod. This pushrod is provided with hard end caps in the regions in which the rod ends interact with the rocker arm and the valve lifter.

Similarly, U.S. Pat. No. 5,154,146 describes a polymer matrix composite pushrod with protective and caps. The pushrod is made from a thermosetting epoxy polymer matrix, reinforced with graphite and/or glass fibers.

U.S. Pat. No. 5,372,100 also describes a polymer matrix composite pushrod. The polymer matrix is a thermosetting resin, and the fibers are glass, graphite or liquid crystal polymers such as Kevlar™ (commercially available from E.I. DuPont de Nemours & Co., Wilmington, Del.).

Each of the references above describes the use a various hard end caps in connection with the composite rod. The end caps are typically made of steel, thereby protecting the ends of the composite rod structure from impact and wear stresses experienced in the region in which the pushrod interacts with the rocker arm and the valve litter.

SUMMARY AND OBJECTS OF THE INVENTION

The present invention relates to a pushrod for the valve train of an internal combustion engine. The pushrod is made from continuous fiber reinforced aluminum matrix composite. The matrix material is either pure aluminum or an aluminum alloy, and the fibers are polycrystalline a-alumina. Of course, other ceramic fiber materials, including carbon, silicon carbide, boron, and the like are contemplated as well.

The structure of the pushrod is that of a hollow tube having hard caps applied at each end. In applications in which the pushrod does not need to be internally cooled by oil, a solid pushrod can be used. The walls of the hollow tube are formed of a continuous fiber reinforced aluminum matrix composite, with the fibers being aligned parallel to the axis of the tube. The end caps are, for example, hardened steel plugs which are inserted into the hollow ends of the tube. The end caps can be hollow, and are shaped to give the optimum fit onto the rocker arm and valve lifter. The caps are bonded to the continuous fiber aluminum composite material of the pushrod tube using a permanent adhesive. Alternatively, the end caps may be mounted to the ends of the tube by brazing, welding, and the like. In one embodiment, the end caps may be sized to allow them to be maintained on the tube ends by a simple press fit.

It is one object of the present invention to provide a lightweight pushrod, made from continuous fiber reinforced aluminum matrix composites, which can withstand the stresses and environment of an internal combustion engine.

It is a further object of the present invention to provide a manufacturing method for the aforementioned pushrod, at a cost acceptable to the automotive industry.

It is a further object of the present invention to provide a continuous fiber reinforced aluminum matrix composite pushrod which will increase engine power, engine speed, and fuel efficiency, as well as decrease engine noise.

It is a further object of the present invention to provide a continuous fiber reinforced aluminum matrix composite pushrod which has superior mechanical and vibrational damping properties as compared to existing pushrods.

It is a further object if the present invention to provide a continuous fiber reinforced aluminum matrix composite pushrod which will improve valve control and performance in conditions across the entire rpm range in an internal combustion engine.

DETAILED DESCRIPTION OF THE INVENTION

Figure 1:
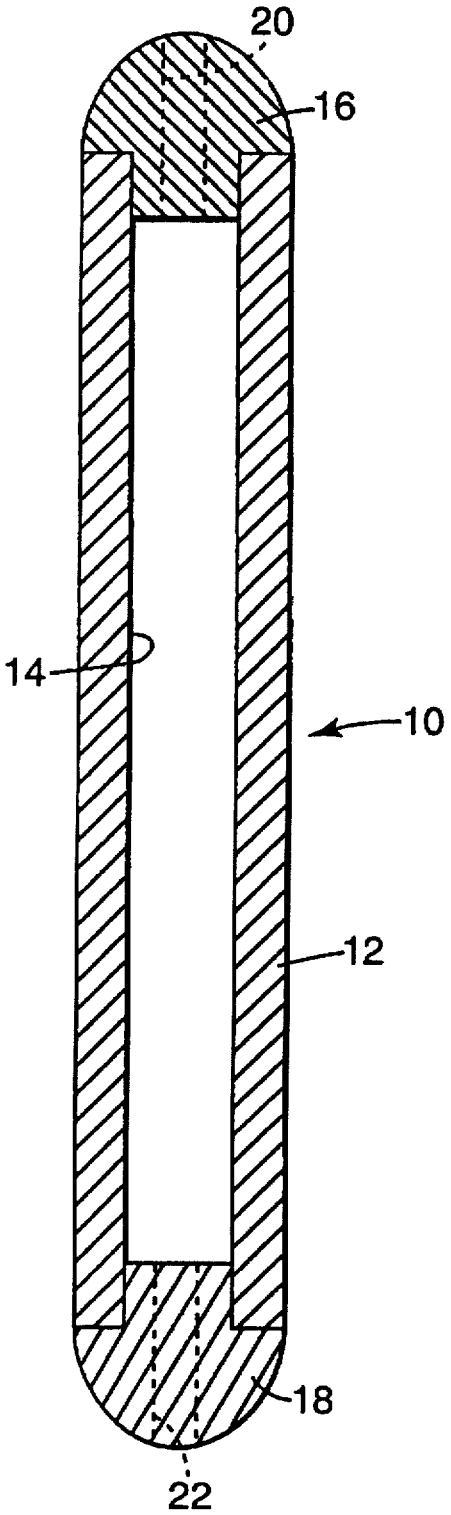
FIG. 1 is a schematic cross-sectional view of a continuous fiber reinforced aluminum matrix composite pushrod.

In general terms, a fiber reinforced matrix composite material includes a matrix material which is reinforced with continuous or discontinuous fibers formed of a material which differs from that forming the matrix. However, the fiber reinforced matrix composite materials of the present invention are those which use continuous or substantially continuous fibers. As used herein, continuous fiber reinforced aluminum matrix composites are characterized as structures in which a matrix of either pure aluminum or an aluminum alloy is reinforced with continuous aluminum oxide fibers. In this context, "continuous" is intended to mean a fiber having a length which is relatively infinite when compared to the fiber diameter. In practical terms, such fibers have a length on the order of about 15 cm to at least several meters, and may even have lengths on the order of kilometers or more. Of course, for structures having lengths of less than about 15 cm, "continuous" implies that the fiber length approximates that of the composite structure within which the part is used. This case may be contrasted with structures in which reinforcing "whiskers" or chopped fibers, having lengths substantially less than that of the composite part, are used. The term "fiber" as used herein, is intended to mean either a monofilament (i.e., a single fiber element), a tow (i.e., a bundle of fiber elements), or a yarn (i.e., a twisted collection of fiber elements).

The composite materials used in the present invention are made by forming a "preform" of fibers, inserting the preform into a mold, and then pressure casting molten aluminum or aluminum alloy matrix into the mold so as to infiltrate the preform with the molten metal matrix. Full details of the continuous fiber reinforced aluminum matrix composite, and manufacturing methods are described in U.S. patent application Ser. No. 08/492,960 (McCullough et al), the teachings of which are incorporated herein by reference.

In one preferred embodiment, the fiber reinforced aluminum matrix composites of the present invention comprise continuous fibers of polycrystalline $\alpha$-$Al_2O_3$ encapsulated within either a matrix of substantially pure elemental aluminum or an alloy of pure aluminum with up to about 2% copper by weight. As used herein, the term "polycrystalline" means a material having predominantly a plurality of crystalline grains in which the grain size is less than the diameter of the fiber in which the grains are present. The preferred fibers have an equiaxed grain size of less than about 100 nm, and a fiber diameter in the range of about 1–50 micrometers. A fiber diameter in the range of about 5–25 micrometers is preferred with a range of about 5–15 micrometers being most preferred. Preferred composite materials have a fiber density of between about 3.90–3.95 grams per cubic centimeter.

Among the preferred fibers are those described in U.S. Pat. No. 4,954,462 (Wood et al.) the teachings of which are hereby incorporated by reference. Such fibers are available commercially under the designation NEXTEL™ 610 ceramic fibers from the Minnesota Mining and Manufacturing Company, St. Paul, Minn. ("3M"). The encapsulating matrix is selected to be such that it does not react chemically with the fiber material, thereby eliminating the need to provide a protective coating on the exterior of the fibers.

In the preferred embodiments, the use of a matrix comprising either substantially pure elemental aluminum, or an alloy of elemental aluminum with up to about 2% copper has been shown to produce successful composites. As used herein the terms "substantially pure elemental aluminum", "pure aluminum" and "elemental aluminum" are interchangeable and are intended to mean aluminum containing less than about 0.05% impurities by weight. Such impurities typically comprise first row transition metals (titanium, vanadium, chromium, manganese, iron, cobalt, nickel, and zinc) as well as second and third row metals and elements in the lanthanide series. In one preferred embodiment, the terms are intended to mean aluminum having less than about 0.03% iron by weight, with less than about 0.01% iron by weight being most preferred. Minimizing the iron content is desirable because iron is a common contaminant of aluminum, and further, because iron and aluminum combine to form brittle intermetallic compounds (e.g., $Al_3Fe$, $Al_2Fe$, etc.). That notwithstanding, it is recognized that iron sometimes enters the matrix as a result of the casting process. Although it is preferred to prevent this effect, aluminum matrix composites have been found to be more tolerant of minor iron impurities in compressive stress applications such as pushrods, since iron impurities tend to lower tensile strength and fatigue strength in tensile applications.

It is also particularly desirable to avoid contamination by silicon (such as from $SiO_2$, which can be reduced to free silicon in the presence of molten aluminum) because silicon, like iron, forms a brittle phase, and because silicon can react with the aluminum (and any iron which may be present) to form brittle Al-Fe-Si intermetallic compounds. The presence of brittle phases in the composite is undesirable, as such phases tend to promote fracture in the composite when subjected to tensile stresses. In particular, such brittle phases may cause the matrix to fracture even before the reinforcing ceramic fibers fracture, resulting in composite failure. Generally, it is desirable to avoid substantial amounts of any transition metal, (i.e., Groups IB through VIIIB of the periodic table), that form brittle intermetallic compounds. Iron and silicon have been particularly specified herein as a result of their commonality as impurities in metallurgical processes.

Each of the first row transition metals described above is relatively soluble in molten aluminum and, as noted, can react with the aluminum to form brittle intermetallic compounds. In contrast, metal impurities such as tin, lead, bismuth, antimony and the like do not form compounds with aluminum, and are virtually insoluble in molten aluminum. As a result, those impurities tend to segregate to the fiber/matrix interface, thereby weakening the composite strength at the interface. Although such segregation may aid longitudinal strength of the ultimate composite by contributing to a global load sharing domain (discussed below), the presence of the impurities ultimately results in a substantial reduction in the transverse strength of the composite due to decohesion at the fiber/matrix interface. Elements from Groups IA and IIA of the periodic table tend to react with the fiber and drastically decrease the strength of the fiber in the composite. Magnesium and lithium are particularly undesirable elements in this regard, due, in part, to the length of time the fibers and the metal must be maintained at high temperatures during processing or in use.

It should be understood that references to "substantially pure elemental aluminum", "pure aluminum", and "elemental aluminum" as used herein, are intended to apply to the matrix material rather than to the reinforcing fibers, since the fibers will likely include domains of iron (and possibly other) compounds within their grain structure. Such domains typically are remnants of the fiber manufacturing process and have, at most, negligible effect on the overall characteristics of the resulting composite material, since they tend to be relatively small and fully encapsulated within the grains of the fiber. As such, they do not interact with the composite matrix, and thereby avoid the drawbacks associated with matrix contamination.

The metal matrix used in the composite of the present invention is selected to have a low yield strength relative to the reinforcing fibers. In this context, yield strength is defined as the stress at 0.2% offset strain in a standardized tensile test of the unreinforced metal or alloy. Generally, two classes of aluminum matrix composites can be broadly distinguished based on the matrix yield strength. Composites in which the matrix has a relatively low yield strength have a high longitudinal tensile strength governed primarily by the strength of the reinforcing fibers. As used herein, low yield strength aluminum matrices in aluminum matrix composites are defined as matrices with a yield strength of less than about 150 MPa. The matrix yield strength is preferably measured on a sample of matrix material having the same composition and which has been fabricated in the same manner as the material used to form the composite matrix. Thus, for example, the yield strength of a substantially pure elemental aluminum matrix material used in a composite material would be determined by testing the yield strength of substantially pure elemental aluminum without a fiber reinforcement. The test method preferably follows the ASTM tensile test standard E345-93 (Standard Test Methods of Tension Testing of Metallic Foil). In composites with low yield-strength matrices, matrix shearing in the vicinity of the matrix-fiber interface reduces the stress concentrations near broken fibers and allows for global stress redistribution. In this regime, the composite reaches "rule-of-mixtures" strength. Pure aluminum has a yield strength of less than about 13.8 MPa (2 ksi) and Al-2 wt % Cu has a yield strength less than about 96.5 MPa (14 ksi).

Of course, it should be noted that while the aluminum matrix composites described above are characterized, in part, by their high yield strengths, in the present application, compressive loading forces are dominant. As such, the particular matrix/fiber combinations described above, while preferred, are not required for satisfactory pushrod performance. Rather, any of a wide variety of matrix/fiber combinations which offer high resistance to compressive loads and high vibrational damping may be used in connection with the present invention.

One embodiment of a pushrod of the present invention is depicted in FIG. 1. Specifically, FIG. 1 is a schematic cross-sectional view of a continuous fiber reinforced aluminum matrix composite pushrod 10. The pushrod 10 is formed of a continuous fiber reinforced aluminum matrix composite tube 12, having an aperture 14 therethrough through which a coolant fluid such as oil may pass. End caps 16, 18 formed of hardened steel also include apertures 20, 22, respectively, to allow passage of a coolant. The end caps are affixed to the ends of the composite matrix tube using a high strength adhesive such as Scotch-Weld™ two-part epoxy or Scotch-Weld™ one-part epoxy (both commercially available from 3M).

Figure 2A:
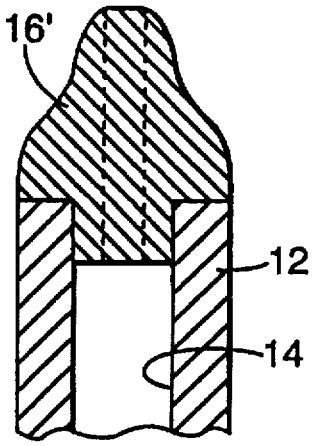
FIG. 2*a* is a schematic cross-sectional view of one end of a continuous fiber reinforced aluminum matrix composite pushrod showing one embodiment of an end cap.
Figure 2B:
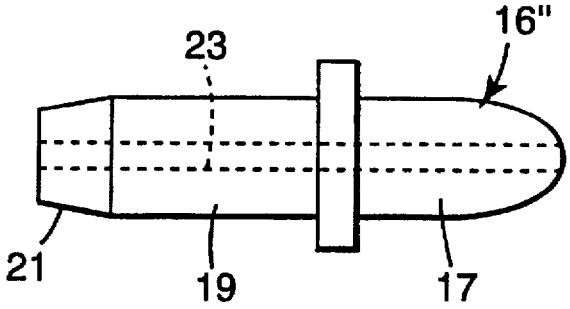
FIG. 2*b* shows another embodiment of an end cap.

Other embodiments, incorporating alternative designs of end caps are depicted in FIGS. 2*a* and 2*b*. In the embodiment of FIG. 2*a*, the end cap 16' has a different shape, to optimize performance with a specific valve train assembly. In the embodiment of FIG. 2*b*, the end cap 16" is characterised by having a head 17 and a shank 19 with a taper 21 at one end. An aperture 23 to allow oil to flow through the end cap is optionally provided. The continuous fiber reinforced aluminum matrix composite pushrod may have the same or different end cap configurations at each of its ends. Various acceptable end caps are commercially available. For example, end caps fabricated from 4130 or 4340 steel, hardened to about 60 Rockwell, are commercially available from Crower Cams and Equipment Company, Chula Vista, Calif. The choice of end cap design is optimized to match the specific rocker arm and valve lifter used in the engine, as well as the specific valve train geometry of that engine.

Figure 3:
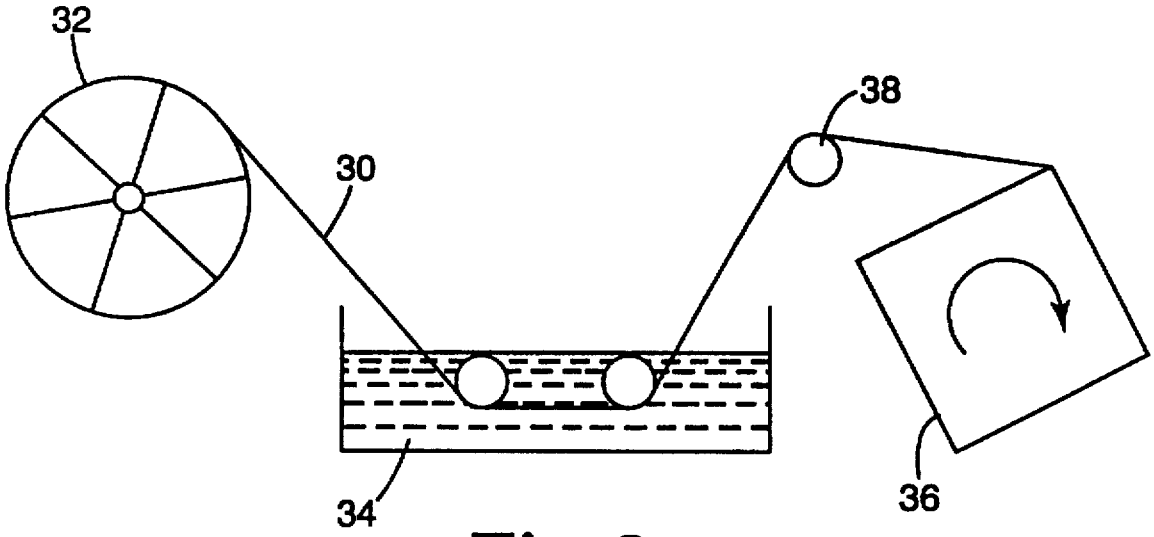
FIG. 3 is a diagram of the process used to wrap the reinforcing fiber around a drum, simultaneously impregnating the fiber tow with ceramic particulates to aid fiber spacing in the composite.

To make the continuous fiber reinforced aluminum matrix composite pushrod of the present invention, the aluminum-based matrix is cast into a preform of polycrystalline α-alumina fibers constrained in a mold. One method for forming the fiber preform is depicted in FIG. 3. In FIG. 3, a "tow" or "roving" 30 of polycrystalline α-alumina fibers, such as Nextel™ 610 fibers is unwound from a spool 32 on which it is stored. Optionally, the fiber tow 30 is pulled through a bath 34 of deionized water which contains a suspension of ceramic particles. Such particles have been found to improve fiber spacing characteristics, thereby improving mechanical properties of the composite formed using such fibers. The ceramic particles are calcined aluminum oxide, in suspension, at a concentration of 1–3% by weight. The particles are commercially available as "AKP-15" alumina powder from Sumitomo Chemical Company Ltd., Japan. Each calcined aluminum oxide particle has a size of preferably less than 5 micrometers, and more preferably, less than 1 micrometer. As the fiber tow 30 is passed through the suspension, calcined aluminum oxide particles are caused to adhere to the individual fibers, thereby impregnating the tow.

The wet, particle-impregnated tow is wound onto a drum 36 having a square cross-section. The drum 36 is selected such that the length of each side (perpendicular to the central axis of the drum) exceeds the final length of the pushrod. While being wound onto the drum, the tow is passed over a roller 38, which is traversed on a motor driven slide, perpendicular to the plane of the paper in FIG. 3, such that a single layer of fibers, with the tows parallel and close to each other, is formed on the rotating drum. In effect, this produces a mat of unidirectionally aligned fiber, well-suited for subsequent rolling around a mandrel to make a tubular fiber preform. This is commonly known as "level winding". The tow is then traversed once or twice more such that a two- or three-layer mat of aligned fibers is built-up on the surface of the drum. The width of the mat is predetermined by calculating the amount of fiber needed to make a continuous fiber reinforced aluminum matrix composite pushrod of known dimensions with between about 20 and 70 volume % (preferably, between 40 and 60 volume %) of fiber in the aluminum matrix composite. For example, to make a pushrod with a final outside diameter of about 0.8 cm (5/16), the width of the fiber mat on the square drum is approximately 140 mm. The fiber spacing is approximately 0.5–0.6 mm, and the mat is two fiber layers thick. The resulting mat can be used in a preform which yields an aluminum matrix pushrod with a fiber volume fraction of approximately 70%. By altering the width of the fiber mat, the fiber spacing or the number of fiber layers, the volume fraction of the fiber in the resulting composite pushrod can be controlled.

Of course, although the drum 36 described above has a square cross-section, the invention is not intended to be limited as such. Rather, drums (or mandrels) with a wide variety of cross-sections, including cylindrical and polygonal cross-sections, may be employed. In each case, the drum or mandrel is selected such that its face(s) are of sufficient dimensions to provide a section of preform without a crease or bend, such that the section of preform is suitable for the intended part to be formed.

The drum 36, with the wet multi-layer preform, is placed in a freezer, and preferably maintained at a temperature of at least approximately −25° C. for about 2 hours. It is then removed, the surface is sprayed with de-ionized water, and re-frozen for a minimum of 15 minutes. The drum is removed from the freezer, and the fiber mat cut at the corners of the drum, to give four mats of fiber. These are re-frozen.

Figure 4:
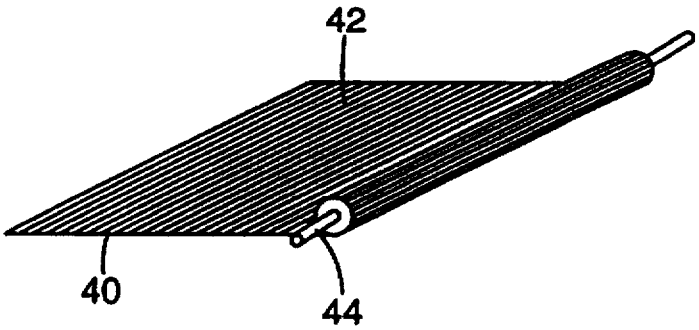
FIG. 4 demonstrates wrapping the fiber mat around a core to make the cylindrical fiber preform needed for the pushrod.

FIG. 4 shows a single mat 40, having three layers of unidirectional fibers 42. The mat 40 is wound around a core 44, which is either a graphite rod or a thin-walled stainless steel tube. In one embodiment, the tube is about 4 mm in diameter. The fibers forming the mat are aligned parallel to the axis of the rod. The core is typically longer that the fiber preform. In one embodiment, the core is approximately 5 cm longer than the preform, thereby allowing approximately 2.5 cm of core to protrude beyond the preform at each end. The protruding core segments provide an area by which the core and mat assembly may be positioned and maintained in a holder for the casting operation. The protruding core segments also assist in maintaining the fiber preform centered within an infiltrating matrix of molten aluminum during the casting operation described below.

Figure 5:
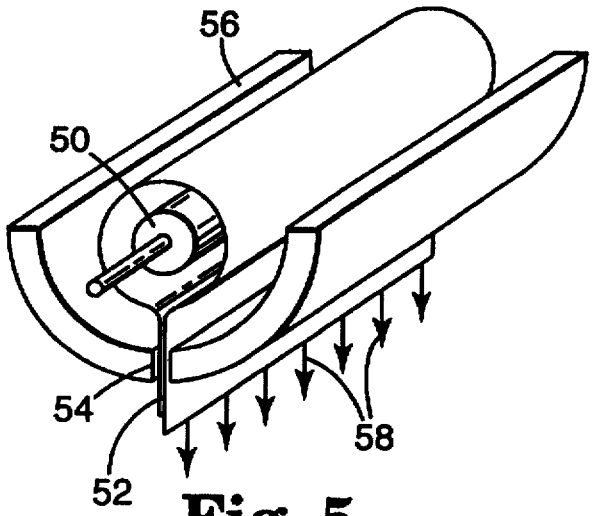
FIG. 5 shows a diagram of the preform compactor. The flat end pieces of the semi-circular tray are not shown for clarity.

As shown in FIG. 5, a compactor is then used to compact and compress the cylindrical preform in the radial direction. In the compacting step, the preform 50 is wrapped with piece of polyester sheet 52. The ends of the sheet are passed through a small slit 54 in the compactor 56. (For clarity, the flat end faces of the compactor are not shown in FIG. 5.) A pulling force, in the direction of the arrows 58, is applied to the ends of the polyester sheet, until it is tightly wrapped around the preform 50. As a result of the compaction pressure applied around the preform by the polyester sheet, the ice in the fiber preform starts to melt. Increasing the compaction pressure, by increasing the pulling force on the ends of the polyester sheet, increases the fiber packing density and drives out excess water from the preform.

Once the preform has been compacted and excess moisture driven out, it is re-frozen. In order to do this quickly, re-freezing is typically, although not necessarily, achieved by immersing the preform in liquid nitrogen. Once refrozen, the preform is inserted into a chilled mold within which it will be infiltrated by the matrix metal. Chilling the mold allows the preform to remain frozen and rigid, thereby aiding mold insertion.

Figure 6:
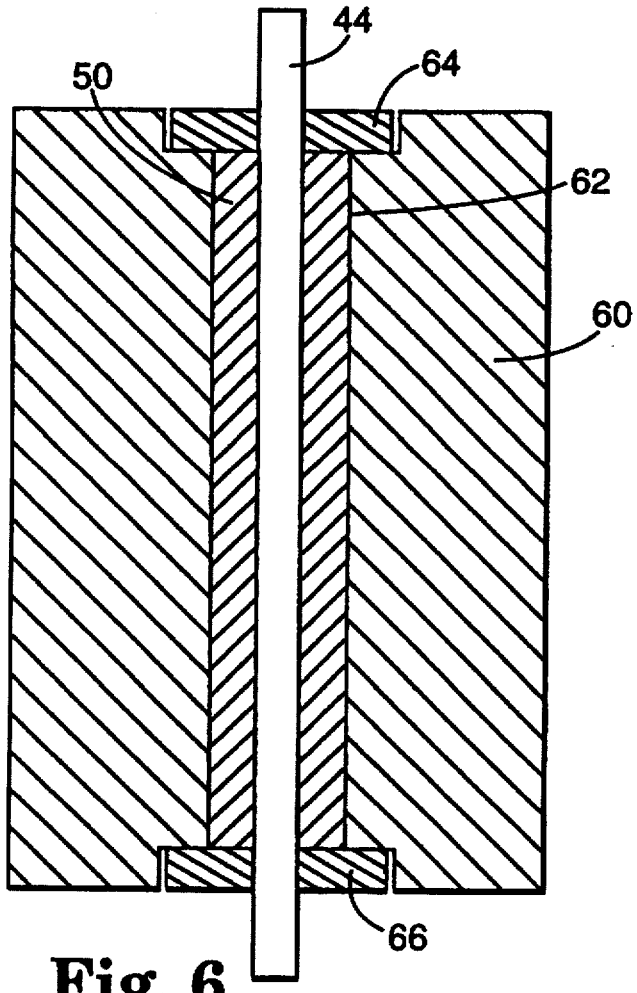
FIG. 6 shows a cross section through a graphite mold, with one hole. The fiber preform and core are shown in the mold, ready for the aluminum matrix to be cast into the fiber preform.

FIG. 6 shows the mold 60, preferably made from a highly temperature-resistant material such as graphite. A mold aperture 62 is machined to accommodate the fiber preform 50 and the core 44, respectively. The dimensions of the mold aperture 62 are preferably similar or just slightly greater that those of the final pushrod. Thus, the holes typically will have a diameter of about 7–12 mm and will be spaced about 10–15 mm apart. Depending on the total size of the mold, a plurality of mold apertures can be drilled to accommodate more than one pushrod preform. For example, in a mold having a 5 cm×10 cm cross section, it is possible to accommodate 12 or more pushrods in a single casting operation, depending on the pushrod diameter.

Circular fixtures 64 and 66, with holes on their centers, are positioned at either end of the holes in the mold. These fixtures are used to hold the rod core 44 in position during casting, thereby ensuring that the core remains positioned in the center of the rod throughout the casting process. The fibers of the preform 50 are aligned with the axis of the core and the mold aperture.

The mold, with frozen preform, is heated to approximately 100° C. and maintained at that temperature for about 2 hours and then is further heated to approximately 200° C. for about 1 hour. The resulting preform will be dry, having had all water driven out during the heat immersion.

When the core is a thin-walled stainless steel tube, the molten aluminum or aluminum alloy is pressure cast into the graphite mold. In addition to impregnating the fibers, molten metal also flows into the interior of the hollow stainless steel tube. To make a hollow pushrod, this metal must be removed by, for example, a drilling procedure.

Subsequently, the fiber preform, still mounted in the graphite mold, is converted into a continuous fiber metal matrix composite structure by infiltrating the preform with a molten metal or metallic alloy. The infiltration is accomplished by filling the mold with the molten aluminum alloy and subjecting the mold to elevated pressure. Such a process, referred to herein as "pressure casting" is more fully described in U.S. Pat. No. 3,547,180. The resulting continuous fiber reinforced aluminum matrix composite pushrods are said to be cast to "near net shape".

The above preforming method uses water as binder to keep the fibers together for winding around the graphite or stainless steel pushrod core. Alternatively, a wax binder may be used. The use of a wax binder eliminates the need for addition of water and the time-consuming freezing/thawing cycles.

When a wax binder is used, the fiber tows are wound around a square drum as before, but the bath contains molten paraffin wax instead of water. Fine alumina particulates may or may not be added as before. After removal from the square drum, the fiber mat is wound directly around the graphite or steel core. No time-consuming freezing/thawing cycles are necessary. The resulting mat may or may not need to be compacted, depending on the required volume fraction. However, to achieve volume fractions of around 70% or more, compaction is necessary. Finally, once the preforms have been inserted into the mold, the wax is removed simply by heating the preforms to around 300° C. in an argon atmosphere.

After casting and cooling, the rods are removed from the mold and, the core of each rod is drilled out. Removal of the core by drilling is relatively easy, since the core is graphite with the graphite-cored rods or aluminum-alloy (the same as the matrix alloy) with the thin-walled stainless steel tubes, since the matrix alloy is simultaneously cast into the fiber preform and into the thin-walled stainless steel tube.

In an alternative embodiment, a thin-walled stainless steel tube may be used for the pushrod core. In that case, the thin-walled stainless steel tube is allowed to remain in the final rod. As a result, the tube acts as a steel lining for the aperture which passes through the center of the pushrod. The liner is preferably on the order of about 0.2–0.5 mm in thickness.

To achieve a desired surface finish and outside dimensions, the rod may be subjected to machining steps using, for example, a polycrystalline diamond-tipped cutting tool on a lathe, or a diamond-impregnated grinding apparatus. The pushrods either may have a constant diameter or they may be tapered in a manner such that they are thicker in the center of the pushrod. Alternatively, a "tool post grinder" can be used to machine the pushrod to a desired dimension with a desired surface finish. The rods are each then cut to their desired length using, for example, a polycrystalline diamond-tipped cutter. The cut typically is a straight cut, made perpendicular to the long (central) axis of the pushrod.

Since the continuous fiber reinforced aluminum matrix composite material alone is not hard enough to withstand impact and compressive stresses experienced by the ends of a pushrod in service in an engine, the pushrod ends must be reinforced. In particular, the wear and compressive stresses applied by the rocker arm and the valve lifter in the engine are sufficiently high, so as to deform the ends of a pushrod formed from a continuous fiber reinforced aluminum matrix composite. This may be overcome by inserting hardened end plugs into the ends of the rod. The end plugs are fabricated of, for example, 4130 or 4340 steel that has been heat treated to a Rockwell hardness of about 60. The hardened steel ends are held in place by an adhesive, brazed or welded. In one preferred embodiment, Scotch-Weld™ DP-460 two-part epoxy, (available from 3M) may be used. As noted above, the end caps may be formed in any of a wide variety of shapes to match the mating fixtures on the rocker arm and valve lifter.

End caps 16, 16' and 16" in FIGS. 1, 2*a* and 2*b*, respectively, show specific designs for hardened steel end caps. Steel end caps with alternative designs can be obtained from numerous commercial sources, such as Crower Cams and Equipment Company, Chula Vista, Calif. Each end cap comprises a shaped outer end (head) which contacts the rocker arm or valve lifter, and a shank which is inserted into the central bore of the pushrod. The shank serves to firmly anchor the end cap such that it does not come loose in service.

Preferably, the shank is tapered at its end. The taper is 5 to 45 degrees and typically begins about 1–5 mm from the end of the shank. Such tapers allow room for adhesive to bond the end cap to the pushrod, while also eliminating potentially sharp corners on the end of the shank. This latter effect is desirable, as sharp edges can act as fatigue initiation sites if a bending moment is applied to the pushrod while in service.

EXAMPLES

Example 1

A continuous fiber reinforced aluminum matrix composite pushrod was made using the method described above. Polycrystalline α-alumina fibers, (Nextel™610 fibers, commercially available from 3M, St. Paul, Minn.) were selected as the reinforcing material. The pushrod core was a tube made from 316 stainless steel, having an outside diameter of 4.19 mm and a wall thickness of 0.254 mm. The outer surface of the core was coated with a titanium nitride (TiN) coating having a thickness of about 2 microns. The coating was deposited by cathodic arc plasma deposition at Vergason Technologies Inc., Van Etten, N.Y. The TiN acts as a reaction barrier to aluminum-iron reactions during the casting operation. The matrix was an alloy of aluminum incorporating about 2% copper by weight. The end caps were the same as those designated by reference numeral 3 in FIG. 1.

The continuous fiber reinforced aluminum matrix composite pushrod was tested in a side-by-side comparison with a commercially available 4340 steel pushrod designed for use in a V8 Chevrolet racing engine. Both pushrods were about 20.3 cm long and 7.92 mm in diameter. The continuous fiber reinforced aluminum matrix composite pushrod weighed 28 grams. In contrast, the 4340 steel pushrod weighed 56 grams.

Testing was performed at Crower Cams & Equipment Co. (Chula Vista, CAA) on an Optron™ Model 806B valve motion analyzer (available from Optometrix, Woodbridge, Conn.). An engine block, with no crankshaft or cylinders, was set up with a single valve train using a steel valve spring. The camshaft was driven by an auxiliary engine. As the auxiliary engine increased the rpm, the Optron sensor monitored valve movement, and identified when the valve train went into "soft float" (lightly bouncing on the valve seat) and then hard float, which represents severe valve bouncing, lack of valve control and a loss in engine power.

In the case of the 4340 steel pushrod, soft float started at about 9000 rpm, and the valve train was in hard float at about 9300 rpm. In contrast, when the 4340 steel pushrod was removed and replaced with the continuous fiber reinforced aluminum matrix composite pushrod, no soft float was detected, and hard float did not occur until the camshaft was accelerated to approximately 9400 rpm.

Thus, it was shown that the continuous fiber reinforced aluminum matrix composite pushrod allowed the engine speed to be increased by about 100 rpm. In addition, the superior mechanical and vibrational damping properties of the continuous fiber reinforced aluminum matrix composite pushrod gave better valve control (no soft float) up to the point of hard float.

Example 2

A continuous fiber reinforced aluminum matrix composite pushrod was made using the method described above. Polycrystalline α-alumina fibers, (Nextel™ 610 fibers, commercially available from 3M, St. Paul, Minn.) were selected as the reinforcing material. The pushrod core was made from XT™ graphite, an isotropic, synthetic graphite (available from Poco Graphite Inc., Decatur, Tex.). The diameter of the carbon rod was 3.63 mm. The matrix was an alloy of aluminum incorporating about 2% copper by weight. The end caps were the same as those designated by reference numeral 3 in FIG. 1.

The continuous fiber reinforced aluminum matrix composite pushrod was tested in a side-by-side comparison with a commercially available 4340 steel pushrod designed for use in a V8 Chevrolet racing engine. Both pushrods were about 20.3 cm long and 7.92 mm in diameter. The continuous fiber reinforced aluminum matrix composite pushrod weighed 29 grams. In contrast, the 4340 steel pushrod weighed 56 grams.

Testing was performed on the Option™ testing machine using the same method described in Example 1, above.

In the case of the 4340 steel pushrod, soft float started at about 9000 rpm, and the valve train was in hard float at about 9300 rpm. In contrast, when the 4340 steel pushrod was removed and replaced with the continuous fiber reinforced aluminum matrix composite pushrod, no soft float was detected, and hard float did not occur until the camshaft was accelerated to approximately 9450 rpm.

Thus, it was shown that the continuous fiber reinforced aluminum matrix composite pushrod allowed the engine speed to be increased by about 150 rpm. In addition, the superior mechanical and vibrational damping properties of the continuous fiber reinforced aluminum matrix composite pushrod gave better valve control (no soft float) up to the point of hard float.

Example 3

A continuous fiber reinforced aluminum matrix composite pushrod was made using the same method as described in example 1. The only difference was that the TiN coating step was omitted for this example.

The resulting continuous fiber reinforced aluminum matrix composite pushrods were tested in a side-by-side comparison with a commercially available 4340 steel pushrod designed for use in a V8 Chevrolet racing engine. The continuous fiber reinforced aluminum matrix composite pushrod weighed about 30 g compared to about 56 g for the steel pushrod.

Testing was performed on the Optron™ 806B valve motion analyzer described in example 1. A further difference between the Example 1 and this Example 3, is that in Example 3, a different camshaft is used. Specifically, Example 3 substituted the camshaft of Example 1 with a more agressive cam profile. The more agressive camshaft was characterized by a cam profile capable of a bigger opening envelope, thereby opening the valve further and faster in the same or shorter period of time. In this case, the engine power output was limited by valve train vibrations and a loss of valve control at high engine speeds.

In addition, a titanium valve spring was used instead of an H11 tool steel spring. The improved performance and lower weight of the titanium spring was expected allow the lower weight continuous fiber reinforced aluminum matrix composite pushrod to increase engine performance more than with a steel valve spring.

The steel pushrod and titanium spring gave soft valve float at 7700 rpm, and hard valve float at 8800 rpm.

Substituing the continuous fiber reinforced aluminum matrix composite pushrod for the steel pushrod gave soft float at 9600 rpm and hard float at 9700 rpm.

The lower weight, higher stiffness and improved mechanical damping properties of the continuous fiber reinforced aluminum matrix composite pushrod compared to the steel pushrod almost eliminated soft float and increased the maximum engine speed. This demonstrates that the continuous fiber reinforced aluminum matrix composite pushrod give better valve control, which in turn will increase engine power.

To test for pushrod endurance, a 300/660 pound H11 steel spring was used in place of the titanium spring, and a 1.86:1 rocker ratio was used instead of a 1.52:1 ratio. This was the most aggressive valve train configuration possible with the existing engine set up. After running at the rpm limit for 5 minutes, the valve, the valve spring, the valve lash cap and the rocker arm were all damaged. The continuous fiber reinforced aluminum matrix composite pushrod was intact with no detectable damage.

Example 4

A continuous fiber reinforced aluminum matrix composite pushrod was made using the same method as described in Example 3. The only difference was that this was a bigger pushrod, (i.e., it was 9.53 mm in diameter rather than the 7.94 mm diameter used for the pushrods of the previous examples).

The continuous fiber reinforced aluminum matrix composite pushrod was tested in a side-by-side comparison with a commercially available 4340 steel pushrod designed for use in a 5.5 liter displacement V8 Ford drag racing engine. The continuous fiber reinforced aluminum matrix composite pushrod weighed about 49 g compared to about 82 g for the steel pushrod.

The engine was connected to a dynomometer to measure engine power and torque.

Use of the continuous fiber reinforced aluminum matrix composite pushrods resulted in more horsepower than the steel pushrods over the whole rpm power band. In addition, as the engine speed increased, deleterious vibrations in the valve train lowered engine power at several rpm values, which the engine recovered as rpm increased further. The continuous fiber reinforced aluminum matrix composite pushrods eliminate these vibration, giving a smoother, higher power output over the range of about 7500 to 9300 rpm.

During the tests with steel pushrods, several of the H11 steel valve springs needed to be replaced after each test due to loss of spring pressure. There were no damaged springs with the continuous fiber reinforced aluminum matrix composite pushrods. The damping of vibrations, and elimination of soft float protected the valve springs from vibrational impact damage. Continuous fiber reinforced aluminum matrix composite pushrods were found to protect the valve springs, and increase spring life, a potential source of cost savings through the use of continuous fiber reinforced aluminum matrix composite pushrods compared to steel pushrods.

Equivalents

Various modifications and alterations to this invention will become apparent to those skilled in the art without departing from the scope and spirit of this invention. It should be understood that this invention is not intended to be unduly limited by the illustrative embodiments and examples set forth herein and that such examples and embodiments are presented by way of example only with the scope of the invention intended to be limited only by the claims set forth herein as follows.

What is claimed is:

1. A pushrod for an internal combustion engine, comprising:

a) a hollow rod having a first end, a second end and a central axis, the rod being formed of a fiber reinforced, aluminum matrix composite material; and, b) a first cap positioned at the first end of the hollow rod, and a second cap positioned at the second end of the hollow rod, each cap comprising a metal or metallic alloy that is harder than the fiber reinforced aluminum matrix composite.

2. A pushrod as in claim as in claim 1 wherein the composite material comprises at least one substantially continuous fiber.

3. A pushrod as in claim as in claim 2 wherein the substantially continuous fiber is a substantially continuous ceramic fiber.

4. A pushrod as in claim 3 wherein the substantially continuous ceramic fiber comprises polycrystalline $\alpha$-$Al_2O_3$.

5. A pushrod as in claim 1 wherein the composite material comprises at least one substantially continuous polycrystalline $\alpha$-$Al_2O_3$ fiber contained within a matrix of elemental aluminum.

6. A pushrod as in claim as in claim 4 wherein the polycrystalline $\alpha$-$Al_2O_3$ has a tensile strength of at least about 2.8 GPa.

7. A pushrod as in claim as in claim 5 wherein the matrix of elemental aluminum is substantially free of material phases or domains capable of enhancing brittleness in the fiber or matrix.

8. A pushrod as in claim as in claim 2 wherein said at least one fiber has an outer diameter on the order of about 5–15 micrometers.

9. A pushrod as in claim as in claim 5 wherein the composite material comprises between about 20–70% by volume polycrystalline $\alpha$-$Al_2O_3$ fibers.

10. A pushrod as in claim as in claim 5 wherein the composite material comprises between about 40–60% by volume polycrystalline $\alpha$-$Al_2O_3$ fibers.

11. A pushrod as in claim as in claim 5 wherein said aluminum matrix has a yield strength of less than about 250 MPa.

12. A pushrod as in claim as in claim 5 wherein said aluminum matrix has a yield strength of less than about 20 MPa.

13. A pushrod as in claim as in claim 5 wherein said aluminum matrix contains up to about 2% by weight copper.

14. A pushrod as in claim as in claim 1 wherein the fibers are unidirectionally aligned substantially parallel to the central axis of the hollow rod.

15. A pushrod as in claim as in claim 1 wherein the rod has a uniform outer diameter.

16. A pushrod as in claim as in claim 1 wherein the outer diameter of the rod is smallest near at least one of the first or second ends.

17. A pushrod as in claim as in claim 1 wherein the end caps comprise steel.

18. A pushrod as in claim as in claim 17 wherein the end caps comprise 4130 steel or 4340 steel.

19. A pushrod as in claim as in claim 18 wherein the end caps have a hardness of approximately 60 Rockwell.

20. A pushrod as in claim as in claim 1 wherein the first end cap has a shape which differs from the shape of the second end cap.

21. A pushrod as in claim as in claim 1 wherein the hollow rod has an inner lining comprising steel.

22. A pushrod as in claim as in claim 21 wherein the steel has a thickness of approximately 0.2 to 0.5 mm.

23. A pushrod for an internal combustion engine, comprising:

a) a hollow rod having a first end, a second end and a central axis, the rod being formed of a fiber reinforced, aluminum matrix composite material which comprises a matrix of elemental aluminum or an aluminum alloy having up to about 2% copper by weight, reinforced with a plurality of continuous, polycrystalline $\alpha$-$Al_2O_3$ fibers aligned substantially parallel to the central axis; and, b) a first cap positioned at the first end of the hollow rod, and a second cap positioned at the second end of the hollow rod, each cap comprising 4340 steel hardened to at least about 60 Rockwell.

* * * * *